United States Patent [19]

Schnell

[11] 4,067,402

[45] Jan. 10, 1978

[54] RAMMER

[75] Inventor: Hans Günther Schnell, Hamburg, Germany

[73] Assignee: Van Kooten, B.V., Naarden, Netherlands

[21] Appl. No.: 637,944

[22] Filed: Dec. 5, 1975

[30] Foreign Application Priority Data

Dec. 10, 1974 Netherlands ..... 7416084

[51] Int. Cl.[2] ..... E02D 7/12

[52] U.S. Cl. ..... 173/137; 123/46 H; 123/32 F

[58] Field of Search ..... 173/131, 134, 135, 137, 173/128; 123/49 H, 49 SC, 49 R, 32 B

[56] References Cited

U.S. PATENT DOCUMENTS

| | | | |
|---|---|---|---|
| 2,709,992 | 6/1955 | Graves | 123/32 B |
| 2,804,856 | 9/1957 | Spurlin | 173/135 X |
| 3,303,892 | 2/1967 | Nishimura et al. | 173/135 X |
| 3,679,005 | 7/1972 | Inaba et al. | 173/128 |
| 3,747,693 | 7/1973 | Kümmel | 173/137 X |

FOREIGN PATENT DOCUMENTS

| | | | |
|---|---|---|---|
| 1,484,519 | 6/1969 | Germany | 173/137 |

*Primary Examiner*—Ernest R. Purser
*Assistant Examiner*—William F. Pate, III
*Attorney, Agent, or Firm*—Lewis H. Eslinger

[57] ABSTRACT

In a rammer a piston housed in a combustion cylinder strikes with its impact surface the adapted impact surface of a striker. When the impact surfaces are spherical or flattened the piston may strike against the cylinder wall, as a result of which the cylinder surfaces and the piston surfaces wear off strongly. In accordance with the invention the impact surfaces have a tangential cone having an obtuse apex so that on the one hand a sufficient centering of the piston with respect to the striker is obtained and on the other hand the risk of cracking in piston and striker is prevented.

8 Claims, 13 Drawing Figures

Figure 6:
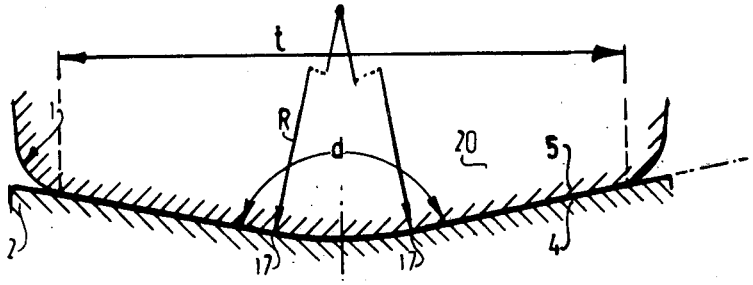

FIG.1
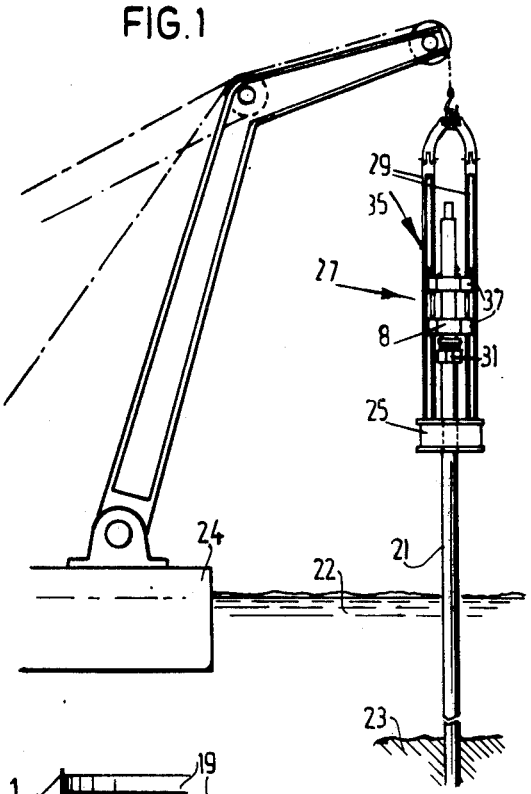
FIG.2
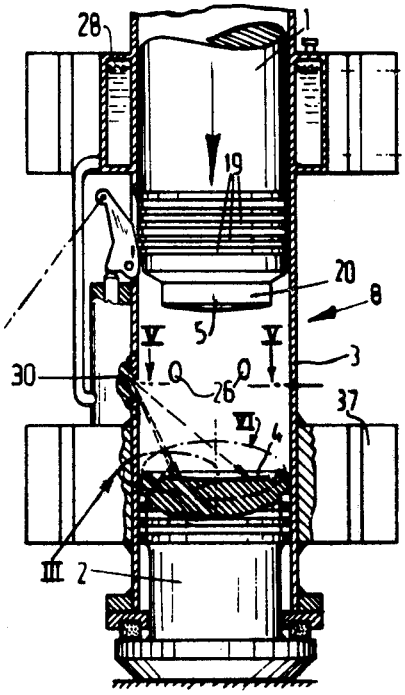
FIG.3
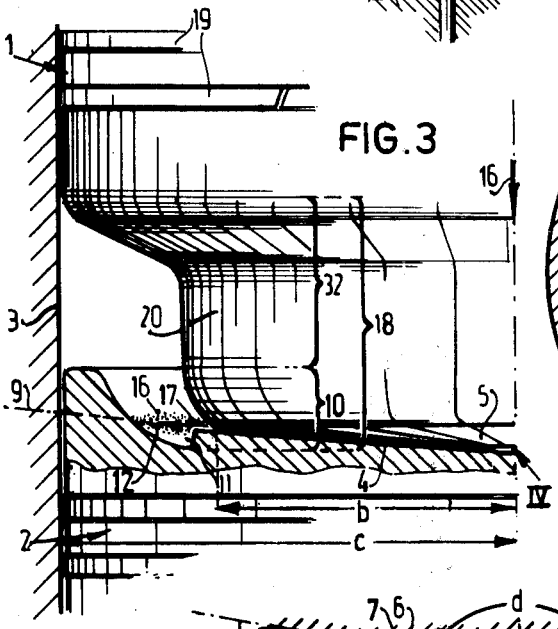
FIG.5
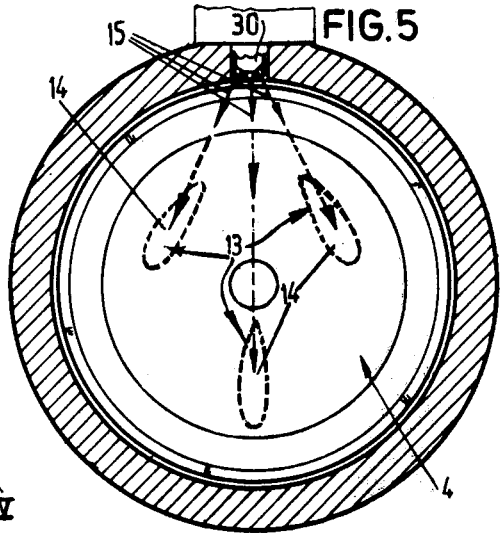
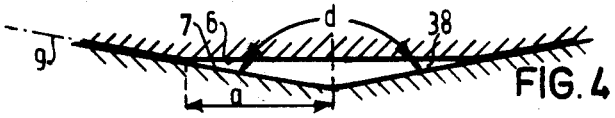
FIG.4

RAMMER

There is known a rammer comprising at least one combustion cylinder, a striking piece extending into the combustion cylinder and a piston housed in the combustion cylinder, in which an impact surface of the striker is adapted to an engaging impact surface of the piston and at least part of each of these impact surfaces is inclined with respect to the axial direction of the combustion cylinder. With a given type of this kind of rammers the impact surface of the piston is spherical, whilst the impact surface of the striker is correspondingly concave. During each stroke the piston and the striker tend to deflect as a whole so that they laterally strike the combustion cylinder and frequently in a manner such that they start rotating with respect to the combustion cylinder. Due to the lateral abuttment and to the relative rotation the combustion cylinder as well as the piston and the striker wear off strongly.

There is furthermore known a rammer of the kind set forth in which the tendency to deflection of the piston and the striker is reduced by a flat structure of both the head face of the piston and the head face of the striker. Particularly when the rammer has large dimensions, for example, as is indispensable for driving thick and long piles into the sea bottom, it is practically not possible to shape the combustion cylinder, the striker and the piston with such accuracy and to maintain the shape during the rough ramming operations that the impact surfaces of the piston and the striker engage one another accurately in the same plane. In fact the piston first strikes the striker at the edges so that the local load of the material is excessive, which gives rise to cracks and bulging of the piston and/or the striker. Due to this eccentric impact the piston and the striker again strike the combustion cylinder and again start rotating relatively to the combustion cylinder, as a result of which the combustion cylinder, the piston and the striker wear off soon.

The invention relates to a rammer comprising at least one combustion cylinder, a striker extending into the combustion cylinder and a piston accommodated in the combustion cylinder, in which an impact surface of the striker matches the engaging impact surface of the piston and at least part of each of these impact surfaces is inclined with respect to the axial direction of the combustion cylinder, the overall impact surfaces of the piston and the striker having each a shape differing from a spherical plane.

A known rammer of the kind set forth comprises a piston and a striker having head faces in the form of a truncated cone having an apex of about 120°. With this rammer there is also the risk of cracking of the piston and/or the striker.

The invention has for its object to considerably reduce the damage and wear of the combustion cylinder, the piston and the striker.

The invention provides an improvement in a rammer comprising at least one combustion cylinder, a striker extending into the combustion cylinder and a piston accommodated in the combustion cylinder, in which an impact surface of the striker matches the engaging impact surface of the piston and at least part of each of said impact surfaces is inclined with respect to the axial direction of the combustion cylinder, the overall impact surfaces of the piston and the striker having each a shape differing from a spherical plane by providing for each inclined part of the impact surfaces a shape mainly in the form of a tangential cone having an apex of less than 180°, but at least 160°. With this shape of the impact surfaces of the piston and the striker an automatic centering on the one hand prevents an excessive load of the edges of the piston and the striker, whereas on the other hand the deflection-resistant engagement of the piston and the striker prevents the piston and the striker from striking the combustion cylinder and from performing a relative rotation causing wear. Since the load of the impact surfaces has a slight radial component, the risk of cracking of the striker and/or the piston is avoided.

Owing to the large apex an existing rammer can be converted into a rammer according to the invention slight free-cutting. In particular an apex of 179° to 175° may be preferred.

The invention provides furthermore a rammer comprising at least one combustion cylinder, a striker extending into the combustion cylinder and a piston arranged in the combustion cylinder, in which the impact surface of the striker matches the engaging impact surface of the piston and at least part of each of these impact surfaces is inclined relatively to the axial direction of the combustion cylinder, the overall impact surfaces of the piston and the striker having each a shape differing from a spherical plane, said rammer being characterized in that the inclined impact surfaces mainly have the shape of a tangent cone having an apex of at least 150°, in which at least each concave part of the impact surfaces of the piston and the striker extends smoothly with a radius of curvature exceeding half the outer diameter of the impact surfaces.

With this configuration of the impact surfaces of the piston and the striker it is also the automatic centering on the one hand which prevents excessive load of the edges of the piston and the striker, whereas on the other hand the deflection-resistant interengagement of the piston and the striker prevents the piston and the striker from striking the combustion cylinder and from starting a relative rotation causing wear. It has been found that with a smooth shape of the head faces with ample rounding-off no cracks occur although with a smaller apex the piston and the striker are materially loaded in a radial direction.

To damage and wear of the piston, the striker and the cylinder of the known rammer contributes inaccurate matching of the impact surfaces. In order to reduce said damage and wear the invention provides a method of manufacturing a rammer characterized in that the impact surfaces of the striker and the piston of said rammer are chipped on a copy-bench and the tool is controlled by one and the same templet in machining the impact surface of the striker and in machining the impact surface of the piston.

The invention furthermore relates to a rammer manufactured by the method in accordance with the invention.

The aforesaid and further features of the invention will be explained in the following description with reference to the drawing.

Figure 10:
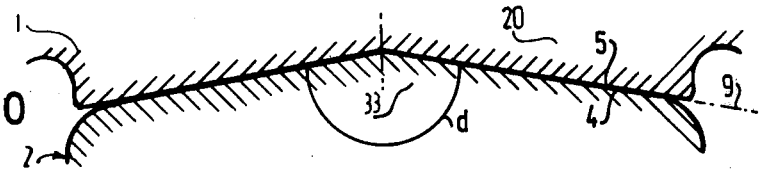
Figure 11:
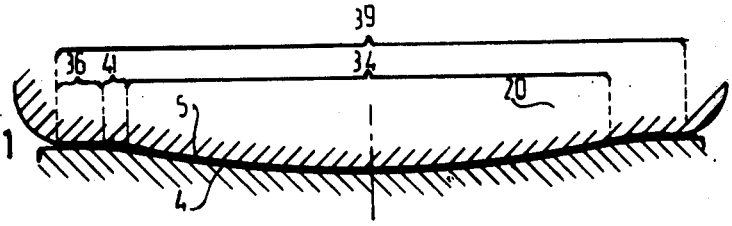
Figure 12:
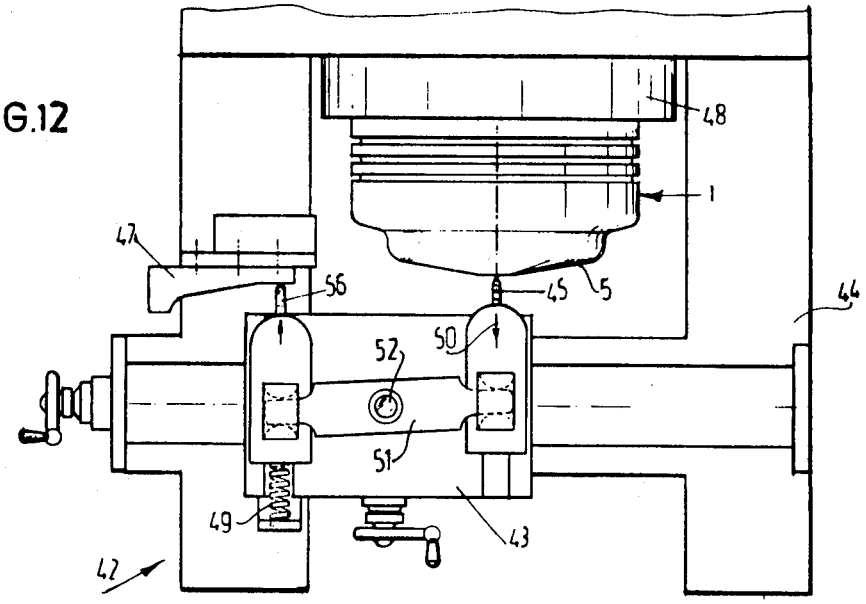
Figure 13:
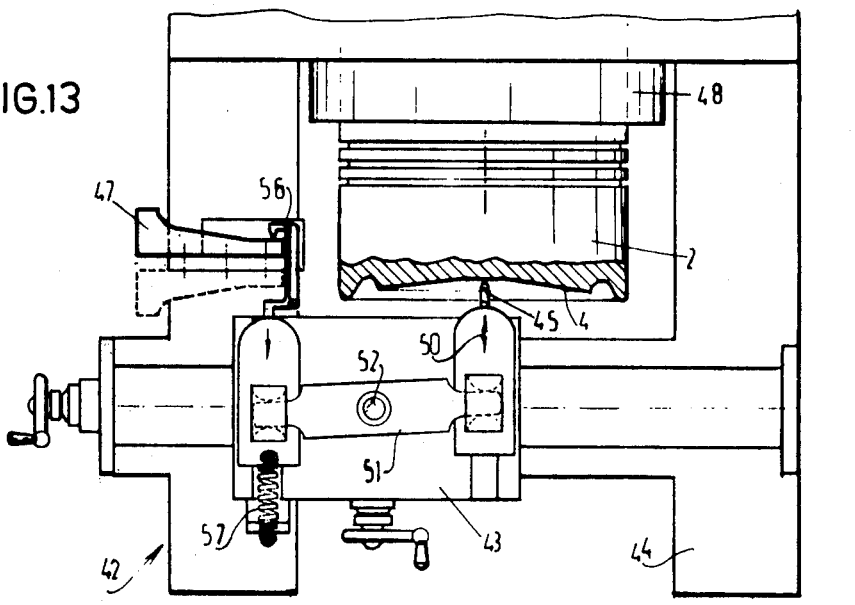

In the drawing:

FIG. 1 is a schematic survey of the pile-driving operation by a pile-driving device equipped with a rammer in accordance with the invention, FIG. 2 is an enlarged vertical sectional view of a rammer of FIG. 1, FIG. 3 shows on an enlarged scale a preferred embodiment of the detail III of FIG. 2, FIG. 4 shows an enlarged detail IV in FIG. 3, FIG. 5 is a sectional view taken on the line V—V in FIG. 2, FIGS. 6 to 11 show each a variant of the detail VI of FIG. 2, and FIGS. 12 and 13 show a copying bench for machining a piston and a striker respectively of a rammer in accordance with the invention.

By means of a floating derrick 24 a pile-driving device 27 is disposed on a pile 21 to be driven into the soil 23 beneath the water 22. This pile-driving device 27 comprises a guiding frame 35 formed by a socket 25 surrounding the pile 21 and by two guide stays 29 secured thereto. The pile-driving device 27 comprises furthermore a rammer 8 moving by means of guide members 37 along the stays 29, particularly a Diesel rammer and a ram cap 31 bearing on the pile 21.

From FIG. 2 it will be seen that the rammer 8 comprises a combustion cylinder 3, a piston 1 operating therein as a hammer and a striker 2 bearing on the ram cap 31 and extending into the combustion cylinder 3. The combustion cylinder 3 holds a tank 28 and has ports 26 for admitting air and for the escape of exhaust gases and a fuel injection nozzle 30.

The piston 1 is sealed with respect to the combustion cylinder 3 by means of piston rings 19 and has a piston head 20 surrounded by an annular compression chamber 18. An impact surface 4 of the striker 2 is adapted to an engaging impact surface 5 of the piston 1, since both impact surfaces are shaped in the form of identical tangent cones 9. The impact surfaces 4 and 5 have an annular shape and have an inner radius *a* and an outer radius *b*, which may be 2.5 and 17 cms respectively, for example, with a radius *c* of 25 cms of the combustion cylinder 3. The apex *d* of the tangent cone 9 is at least 160° and smaller than 180°. Apices between 179° and 175° are particularly preferred, since they provide adequately inclined impact surfaces 4 and 5 relative to the axial direction 16 in order to ensure the required automatic centering of the piston 1 with respect to the combustion cylinder 3 at each stroke. It should be noted that the apex *d* in FIG. 3 is shown, for the sake of clarity, as a more acute angle than the preferred apex.

Inside the impact surfaces 4 and 5 the piston 1 and the striker 2 have head faces 6 and 7 respectively leaving a clearance 38, since the piston 1 is locally flattened. It will be apparent that the overall, annular impact surfaces 4 and 5 of the piston 1 and of the striker 2 have each a shape differing from a spherical plane so that during the stroke of the rammer 8 a deflection-free interengagement of the piston 1 and the striker 2 is ensured, since owing to the automatic centering of the piston 1 with respect to the striker 2 the resultant force of impact is exerted substantially at the centre of the striker 2.

FIG. 5 shows that fuel is sprayed, preferably, onto a plurality of areas 14 distributed along the circumference of the impact surface 4, for example, by three jets 15 from the nozzle 30 so that three fuel zones 13 are formed. When the piston 1 strikes the striker 2 the fuel is atomized, after which a curtain 12 of fuel is sprayed into the lower part of a preceding chamber 10 of the compression chamber 18 because a shallow, annular recess 11 is provided adjacent the impact surface 4 and the striker 2. The fuel is then ignited in the preceding chamber 10 and the combustion takes place slightly later mainly in the combustion chamber 32. This delay of the combustion process improves the impact process of the rammer 8 to a considerable extent.

The shape of the impact surfaces 4 and 5 of FIG. 6 differs from those shown in FIG. 3 in that the impact surfaces 4 and 5 are congruent at the centre and are rounded off. The impact surfaces 4 and 5 are tangential to a cone 9 having an apex *d* of 155°, they have a fully flowing form and are rounded at the centre between the points 17 with a large radius R, which exceeds half the diameter *t* of the impact surfaces.

Figure 7:
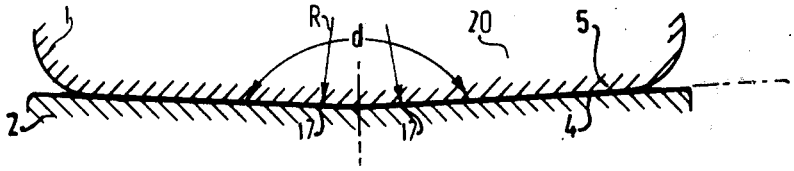

FIG. 7 corresponds with FIG. 6, the difference being that the apex is 174°.

Figure 8:
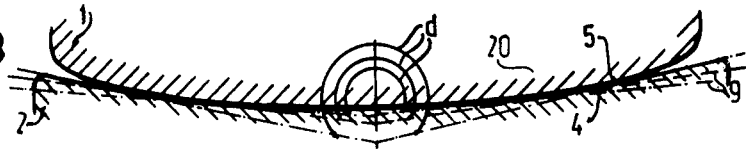
Figure 9:
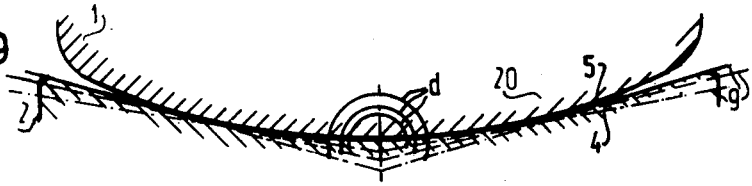

The impact surfaces 4 and 5 of FIGS. 8 and 9 do not exhibit the shape of a cone, but they have the shape of an elliptical arc and a parabola respectively. The various parts of the impact surfaces 4 and 5 are located in different tangent cones having, all of them, a large apex *d* of at least 150°.

FIG. 10 is, in principle, the inverse of FIG. 3, since the piston 1 of FIG. 10 has the shape of the striker 2 of FIG. 3 and the striker 2 of FIG. 10 has the shape of the piston 1 of FIG. 3. This FIG. 10 shows that the apex *d* may point upwards instead of downwards.

FIG. 11 shows that without objection a portion 34 of the impact surfaces 4 and 5 may be accurately spherical, whereas the overall surface 39 of the impact surfaces 4 and 5 has to differ from the spherical shape. As shown in FIG. 11, the central part 34 ensures the required centering effect, whereas the horizontal, annular surface 36 provides the resistance to deflection. A flowing transitional part 41 is provided between the central portion 34 and the ring surface 36.

With any shape of the impact surfaces 4 and 5 it is important that these impact surfaces should satisfactorily fit to one another. In the method illustrated in FIGS. 13 and 14 the impact surfaces 5 and 4 of the piston 1 and the striker 2 are chipped on a mechanical copy-bench 42, whose support 43 is moved with respect to a frame 44 and whose tool 45, for example a chisel, is moved in an axial direction 50 with respect to the support 43. The axial movement is controlled through a feeler 56 in known manner by means of a templet 47. FIGS. 12 and 13 show that the piston 1 and the striker 2 respectively are secured to the rotatable work piece holder 48. Each time one and the same templet 47 is employed for controlling the tool 45. The feeler 56 and the support 43 are coupled with one another through a lever 51 afforded by a shaft 52. Referring to FIGS. 13 and 12 the feeler 56 is held in engagement with the templet 47 by a tensile spring 57 and a compression spring 49 respectively. In FIG. 12 the templet 47 is inverted with respect to that shown in FIG. 13. It should be noted that the copy-bench 42 may be controlled electronically or hydraulically instead of being driven mechanically.

What I Claim is:

1. A rammer comprising at least one combustion cylinder, a striker extending into the combustion cylinder and being slidable therein and a piston arranged in the combustion cylinder for movement therein, said striker and piston having impact surfaces with the impact surface of the striker matching and being generally complementary to the impact surface of the piston which it engages, at least part of each of said impact surfaces being inclined with respect to the axial direction of the combustion cylinder and the overall impact surfaces of the piston and the striker having each a shape different from a spherical plane, wherein each inclined part of said impact surfaces has the general shape of a tangent cone having an apex of less than 180° but of at least 160°.

2. A rammer as claimed in claim 1, wherein said apex lies between 179° and 175°.

3. A rammer comprising at least one combustion cylinder, a striker extending into the combustion cylinder and being slidable therein and a piston accommodated in the combustion cylinder for movement therein, said striker and piston having impact surfaces with the impact surface of the striker matching the impact surface of the piston it engages and at least part of each of said impact surfaces being inclined with respect to the axial direction of the combustion cylinder, the overall impact surfaces of the piston and the striker having a shape differing from a spherical plane, wherein the inclined impact surfaces have the general shape of a tangent cone having an apex of at least 150° and less than 180° with at least each concave part of the impact surfaces of the piston and the striker having a smooth variation with a radius of curvature exceeding half the outer diameter of the impact surfaces.

4. A rammer as defined in claim 1 wherein said impact surfaces are generally conical and complementary.

5. A rammer as defined in claim 4 wherein one of said impact surfaces is frustro-conical and has a centrally located flat surface.

6. A rammer as defined in claim 4 wherein said impact surfaces each include a central spherical portion having a radius of curvature exceeding half the outer diameter of the impact surfaces.

7. A rammer as defined in claim 1 wherein said impact surfaces having the shape of an elliptical arc in section.

8. A rammer as defined in claim 1 wherein said impact surfaces have the shape of a parabola in section.

* * * * *